US006232929B1

(12) United States Patent
Ermutlu et al.

(10) Patent No.: US 6,232,929 B1
(45) **Date of Patent: *May 15, 2001**

(54) MULTI-FILAR HELIX ANTENNAE

(75) Inventors: Murat Ermutlu, Helsinki; Kari Kalle-Petteri Kiesi, Espoo, both of (FI)

(73) Assignee: Nokia Mobile Phones Ltd., Espoo (FI)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/193,771

(22) Filed: Nov. 17, 1998

(30) Foreign Application Priority Data

Nov. 27, 1997 (FI) ..... 974352

(51) Int. Cl.[7] ..... H01Q 1/36

(52) U.S. Cl. ..... 343/895; 343/702

(58) Field of Search ..... 343/895, 702; H01Q 1/36, 1/24

(56) References Cited

U.S. PATENT DOCUMENTS

| | | | | |
|---|---|---|---|---|
| 4,148,030 | * | 4/1979 | Foldes | 343/895 |
| 4,998,078 | | 3/1991 | Hulkko | 333/109 |
| 5,134,422 | | 7/1992 | Auriol | 343/895 |
| 5,276,920 | | 1/1994 | Kuisma | 455/101 |
| 5,341,149 | | 8/1994 | Valimaa et al. | 343/895 |
| 5,489,916 | | 2/1996 | Waterman et al. | 343/895 |
| 5,561,439 | | 10/1996 | Moilanen | 343/846 |
| 5,581,268 | | 12/1996 | Hirshfield | 343/853 |
| 5,627,550 | | 5/1997 | Sanad | 343/700 MS |
| 5,657,028 | | 8/1997 | Sanad | 343/700 MS |
| 5,668,559 | | 9/1997 | Baro | 343/702 |
| 5,680,144 | | 10/1997 | Sanad | 343/700 MS |
| 5,701,130 | * | 12/1997 | Thill et al. | 343/895 |
| 5,734,351 | | 3/1998 | Ojantakanen et al. | 343/702 |
| 5,808,585 | * | 9/1998 | Frenzer et al. | 343/895 |
| 5,854,608 | * | 12/1998 | Leisten | 343/895 |
| 5,963,180 | * | 10/1999 | Leisten | 343/702 |

FOREIGN PATENT DOCUMENTS

| | | |
|---|---|---|
| 0 805 513 A2 | 5/1997 | (EP) . |
| 96/19846 | 6/1996 | (WO) . |
| 97/41695 | 6/1997 | (WO) . |
| 98/15028 | 9/1998 | (WO) . |

OTHER PUBLICATIONS

"Mobile Antenna Systems Handbook", Fujimoto et al., Norwood, 1994, Artech House, pp. 455,457.

* cited by examiner

*Primary Examiner*—Hoanganh Le
(74) *Attorney, Agent, or Firm*—Perman & Green, LLP

(57) ABSTRACT

A quadrifilar helix antenna has four inter-twined helical antenna elements offset from one another by 90°. The elements are identical and each can be defined by an axial coefficient z, a radial coefficient r, and an angular coefficient θ. While the radial coefficient r remains constant along the axis of the elements, the axial coefficient is defined in terms of the angular coefficient according to:

$$z = \theta + a\sin\left(\frac{2\pi b\theta}{l_{ax}}\right) + c\sin\left(\frac{2\pi d\theta}{l_{ax}}\right)$$

where a,b,c, and d are constants which control the non-linearity of the helical element and $l_{ax}$ is the axial length of the element.

14 Claims, 3 Drawing Sheets

MULTI-FILAR HELIX ANTENNAE

FIELD OF THE INVENTION

The present invention relates to multi-filar helix antennae and in particular, though not necessarily, to quadrifilar helix antennae.

BACKGROUND OF THE INVENTION

A number of satellite communication systems are today in operation which allow users to communicate via satellite using only portable communication devices. These include the Global Positioning System (GPS) which provides positional and navigational information to earth stations, and telephone systems such as INMARSAT (TM). Demand for this type of personal communication via satellite (S-PCN) is expected to grow significantly in the near future.

One area which is of major importance is the development of a suitable antenna which can communicate bi-directionally with a relatively remote orbiting satellite with a satisfactory signal to noise ratio. Work in this area has tended to concentrate on the quadrifilar helix (QFH) antenna (K. Fujimoto and J. K. James, "Mobile Antenna Systems Handbook", Norwood, 1994, Artech House), pp. 455, 457. As is illustrated in FIG. 1, the QFH antenna 1 comprises four regular and identical inter-wound resonant helical elements 2*a* to 2*d*, centered on a common axis A and physically offset from one another by 90°. In reception mode, signals received from the four helical elements are phase shifted by 0°, 90°, 180°, and 270° respectively prior to combining them in the RF receiving unit of the mobile device. Similarly, in transmission mode, the signal to be transmitted is split into four components, having relative phase shifts of 0°, 90°, 180°, and 270° respectively, which are then applied to the helical elements 2*a* to 2*d*.

The QFH antenna has proved suitable for satellite communication for three main reasons. Firstly it is relatively compact (compared to other useable antennae), a property which is essential if it is to be used in a portable device. Secondly, the QFH antenna is able to transmit and receive circularly polarised signals so that rotation of the direction of polarisation (due to for example to movement of the satellite) does not significantly affect the signal energy available to the antenna. Thirdly, it has a spatial gain pattern (in both transmission and reception modes) with a main forward lobe which extends over a generally hemispherical region. This gain pattern is illustrated in FIG. 2 for the antenna of FIG. 1, at an operating frequency of 1.7 GHz. Thus, the QFH antenna is well suited for communicating with satellites which are located in the hemispherical region above the head of the user.

A problem with the QFH antenna however remains it's large size. If this can be reduced, then the market for mobile satellite communications devices is likely to be increased considerably. One way to reduce the length of a QFH antenna for a given frequency band is to reduce the pitch of the helical elements. However, this tends to increase the horizontal gain of the antenna at the expense of the vertical gain, shifting the gain pattern further from the ideal hemisphere. Another way to reduce the length of the antenna is to form the helical elements around a solid dielectric core.

However, this not only increases the weight of the antenna, it introduces losses which reduce the antenna gain.

SUMMARY OF THE INVENTION

It is an object of the present invention to improve the design flexibility of multi-filar helix antennae to allow gain patterns to be tailored for particular applications. It is also an object of the present invention to reduce the length of QFH antennae used for satellite communication.

According to a first aspect of the present invention there is provided a multi-filar helix antenna having a plurality of inter-wound helical antenna elements, each helical element being defined by an axial coefficient z, a radial coefficient r, and an angular coefficient θ, wherein dθ/dz for at least one of the helices is non-linear with respect to the axial coefficient z.

The present invention introduces into the design of multi-filar helix antennae a variable which has not previously been applied. By carefully introducing non-linear changes into the structure of a helical element of the multi-filar helix antenna, the spatial gain pattern of the antenna may be optimised. Moreover, the axial length of the antenna may be reduced.

Preferably, dθ/dz for all of the helical elements is non-linear with respect to the axial coefficient z. More preferably, dθ/dz varies, with respect to z, substantially identically for all of the helical elements.

Preferably, dθ/dz for said at least one helical element varies periodically. More preferably, the period of this variation is an integer fraction of one turn length of the helical element. Alternatively, the period may be an integer multiple of the turn length.

Preferably, the axial coefficient z is a sinusoidal function of the angular coefficient θ, i.e. $z=k_0\theta+f\sin(k_1\theta)$ where $k_0$ and $k_1$ are constants. The axial coefficient z may be a sum of multiple sinusoidal functions of the angular coefficient, i.e. $z=k_0\theta+f_1\sin(k_1\theta)+\ldots+f_n\sin(k_n\theta)$. The functions $f$ may be multiplying constants.

Preferably, the radial coefficient r is constant with respect to the axial coefficient z for all of the helical elements. The helical elements may be provided around the periphery of a cylindrical core. Alternatively, r may vary with respect to z. For example, r may vary linearly with respect to z for one or more of the helical elements, e.g. by providing the or each helical element around the periphery of a frusto-cone. In either case, the core may be solid, but is preferably hollow in order to reduce the weight of the antenna. A hollow core may comprise a coiled sheet of dielectric material. The helical elements may be metal wire strands wound around the core, metal tracks formed by etching or growth, or have any other suitable structure. The properties of the antenna may be adjusted by forming throughholes in the core or by otherwise modifying the dielectric properties of the core.

Preferably, the multi-filar helix antenna is a quadrifilar helix antenna, having four helical antenna elements. The antenna elements are preferably spaced at 90° intervals although other spacings may be selected. Non-linearity may be introduced into one or more of the helical elements in order to improve the approximation of the main frontal lobe of the antenna gain pattern to a hemisphere, and to reduce back lobes of the gain pattern, or to tailor the gain pattern to any other desired shape. The invention applies also to other multi-filar antennae such as bi-filar antennae.

Multi-filar antennae embodying the present invention may be arranged in use to be either back-fired or end-fired by appropriate phasing of the helical elements.

According to a second aspect of the present invention there is provided a mobile communication device comprising a multi-filar antenna according to the above first aspect of the present invention. The device is preferably arranged to communicate with a satellite. More preferably, the device is a satellite telephone.

According to a third aspect of the present invention there is provided a method of manufacturing a multi-filar helical antenna having a plurality of helical antenna elements, the method comprising the steps of:

forming a plurality of elongate conducting antenna elements on a surface of a substantially planar dielectric sheet, at least one of said elements being non-linear; and subsequently coiling said sheet into a cylinder with said antenna elements being on the outer surface of the cylinder.

BRIEF DESCRIPTION OF THE DRAWINGS

For a better understanding of the present invention and in order to show how the same may be carried into effect, reference will now be made, by way of example, to the accompanying drawings, in which.

DETAILED DESCRIPTION

Figure 1:
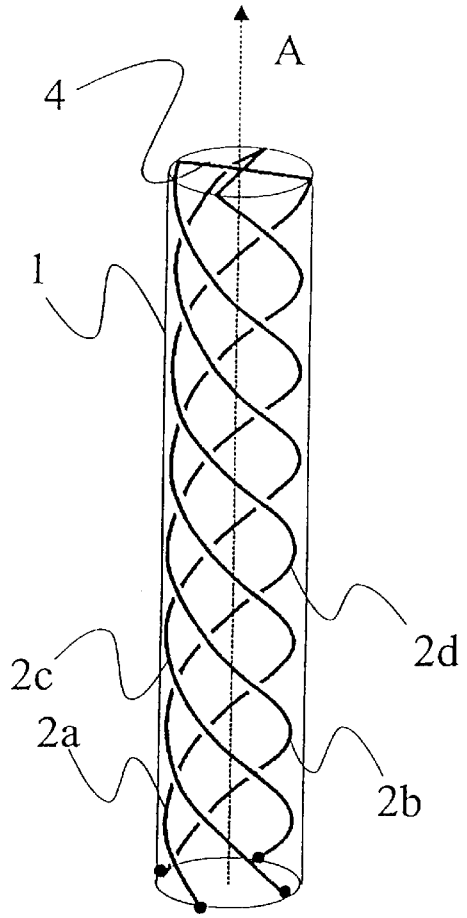
Figure 1 PRIOR ART
FIG. 1 illustrates a quadrifilar helix antenna according to the prior art.
Figure 3A:
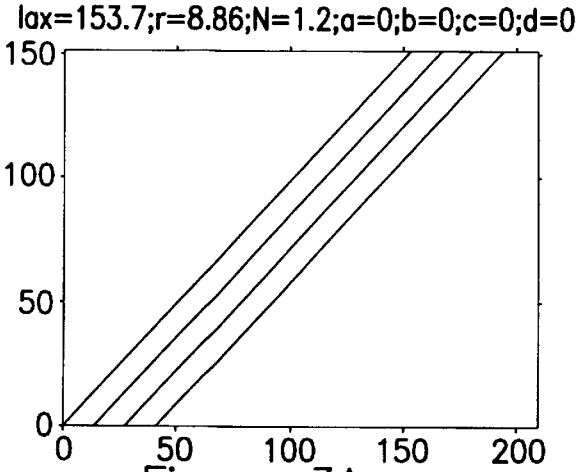
Figure 3A PRIOR ART
FIGS. 3A to 3D show axial coefficient z versus angular coefficient θ for respective helical antenna elements.

There has already been described, with reference to FIG. 1, a conventional quadrifilar helix antenna 4. The antenna is formed from four regular helical elements 2*a* to 2*d* where, for each element, the axial coefficient z is a linear function of the angular coefficient θ, i.e. z=kθ where k is a constant. This is illustrated in two-dimensions in FIG. 3A, which effectively shows the helical elements uncoiled. The vertical axis therefore corresponds to z whilst the horizontal axis is proportional to the angular coefficient θ (the dimensions on both axes are millimeters). The axial length z of the antenna of FIGS. 1 and 3A is 15.37 cm, the radius r is 0.886 cm, and the number of turns N is 1.2.

In order to add non-linearity to the helical element, the axial coefficient can be described by:

$$z = \theta + a\sin\left(\frac{2\pi b\theta}{l_{ax}}\right) + c\sin\left(\frac{2\pi d\theta}{l_{ax}}\right)$$

where a,b,c, and d are constants which control the non-linearity of the helical element and $l_{ax}$ is the axial length of the element. a,c can be thought of as the amplitude of the non-linear variation whilst b,d can be thought of as the period of the variation. The rate of change of θ with respect to z, dθ/dz, becomes non-linear with respect to z, as a result of the sinusoidal variation introduced into z. With a,b,c, and d equal to zero, then the helical element is linear, i.e. as in the antenna of FIGS. 1 and 3A.

Figure 3B:
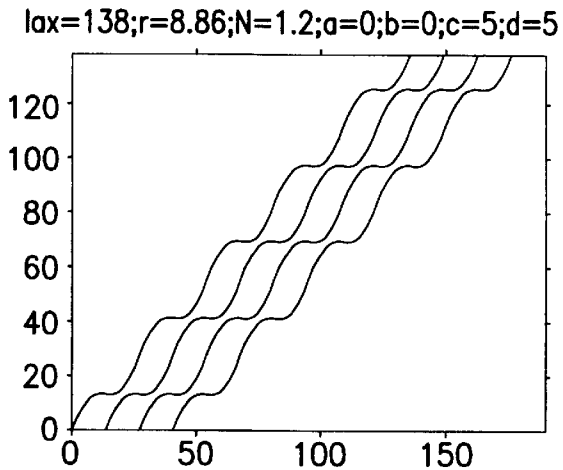
Figure 3C:
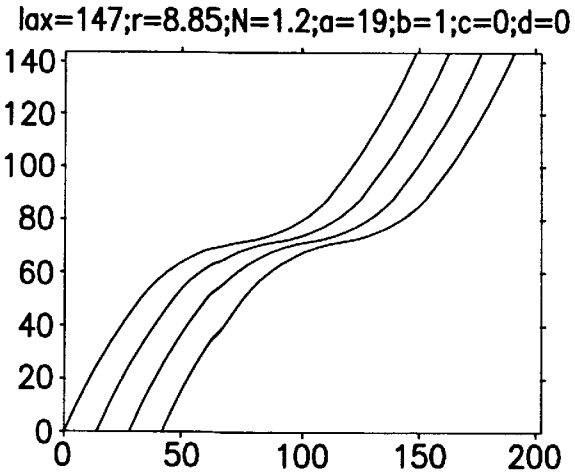
Figure 3D:
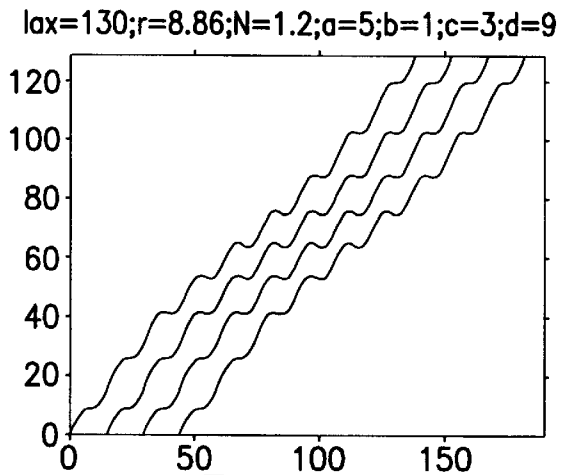

FIGS. 3B to 3D show two-dimensional representations for QFH antennae with non-linear helical elements and which can be described with the above expression, where the coefficients a,b,c, and d have the values shown in the following table, the number of turns is fixed at N=1.2, and the radius r is fixed at 0.886 cm. These antennae are designed to operate at 1.7 GHz. The table also shows the coefficients of the linear antenna of FIG. 3A for comparison.

| FIG. | $I_{ax}$(cm) | N | r(cm) | a | b | c | d | $f_0$(GHZ) |
|---|---|---|---|---|---|---|---|---|
| 3A | 15.37 | 1.2 | 0.886 | 0 | 0 | 0 | 0 | 1.7 |
| 3B | 13.8 | 1.2 | 0.886 | 0 | 0 | 5 | 5 | 1.7 |
| 3C | 14.7 | 1.2 | 0.886 | 19 | 1 | 0 | 0 | 1.7 |
| 3D | 13.0 | 1.2 | 0.886 | 5 | 1 | 3 | 9 | 1.7 |

Also included in the above table are the axial lengths $l_{ax}$ of the QFH antennae, from which it is apparent that where non-linearity is introduced into either pitch or shape, the axial length of the antenna is reduced for a given radius and number of turns.

Figure 2:
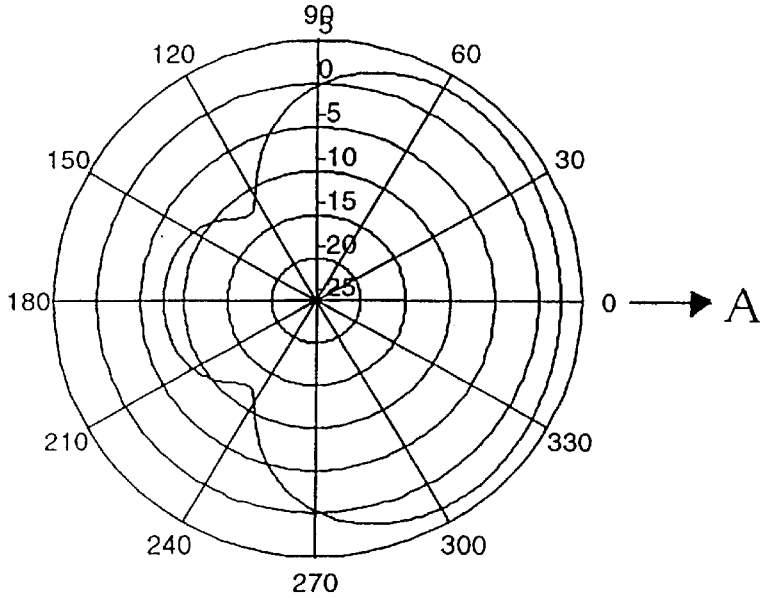
Figure 2 PRIOR ART
FIG. 2 illustrates the spatial gain pattern, in cross-section, of the quadrifilar helix antenna of FIG. 1.
Figure 4:
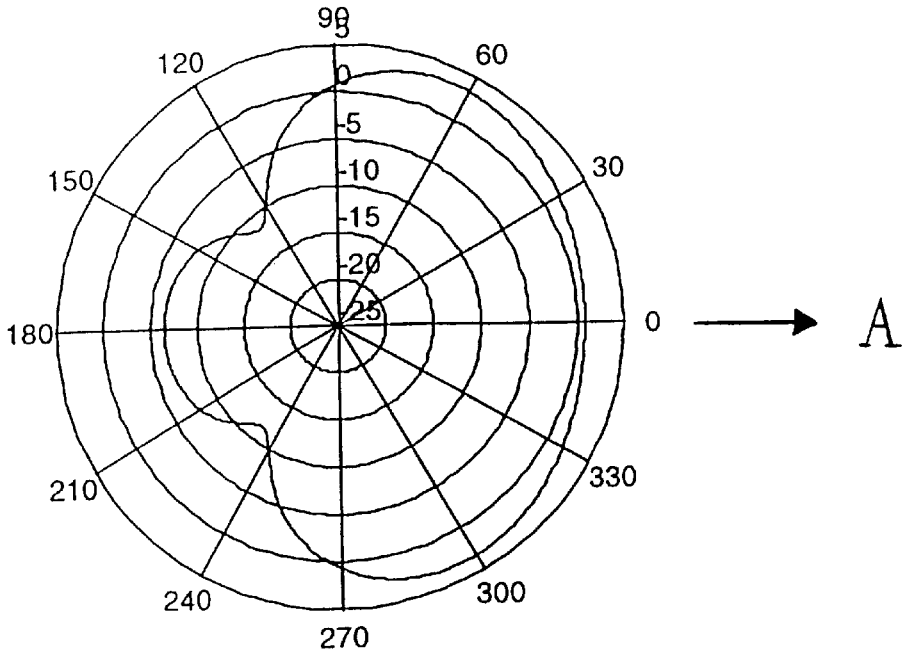
FIG. 4 illustrates the spatial gain pattern, in cross-section, of the quadrifilar helix antenna constructed according to FIG. 3B.

FIG. 4 shows the spatial gain pattern for the QFH antenna of FIG. 3B at 1.7 GHz. Comparison with the gain pattern of the antenna of FIG. 3A, shown in FIG. 2, shows that the introduction of non-linearity into the helical elements reduces the gain in the axial direction by ~2.5 dB. However, this reduction is compensated for by a reduction in the length of the antenna by 1.57 cm. Where the QFH antenna is designed to communicate with satellites in low earth orbits, the distortion of the gain pattern may even be advantageous.

Figure 5:
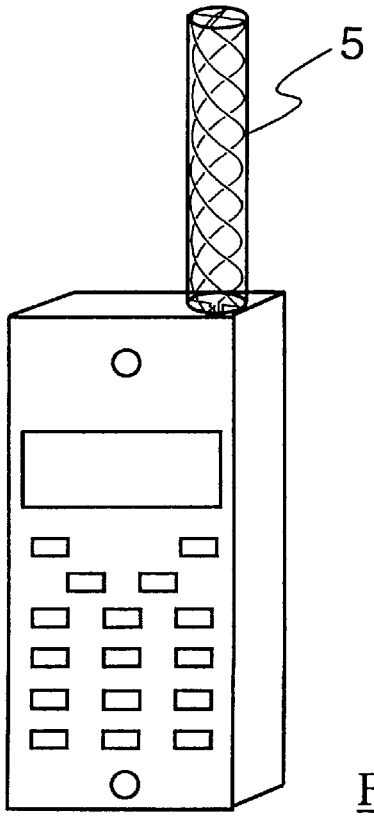
FIG. 5 shows a phone having a multi-filar helix antenna according to the invention.

FIG. 5 shows a phone having a multi-filar helix antenna 5 according to the invention. The phone can be e.g. a mobile communication device such as a mobile phone, or a satellite telephone.

It will be appreciated that various modifications may be made to the above described embodiments without departing from the scope of the present invention.

What is claimed is:

1. A multi-filar helix antenna having a plurality of intertwined helical antenna elements, each helical element being defined by an axial coefficient z, a radial coefficient r, and an angular coefficient θ, wherein dθ/dz for all of the helical elements is a non-linear function with respect to the axial coefficient z.

2. The antenna according to claim 1, wherein dθ/dz varies, with respect to z, substantially identically for all of the helical elements.

3. The antenna according to claim 1, wherein dθ/dz for at least one of said helical elements, varies periodically.

4. The antenna according to claim 3, wherein a period of variation is an integer fraction of one turn length of the helical elements or the period is an integer multiple of turn length.

5. The antenna according to claim 4, wherein, for said helical elements the axial coefficient z is a sinusoidal function of the angular coefficient θ.

6. The antenna according to claim 5, wherein the sinusoidal function is $z=k_0\theta+f\sin(k_1\theta)$ where $k_0$ and $k_1$ are constants.

7. The antenna according to claim 4, wherein, for said elements the axial coefficient z is a sum of multiple sinusoidal functions of the angular coefficient θ.

8. The antenna according to claim 7, wherein the sinusoidal function is $z=k_0\theta+f\sin(k_1\theta)+f_2\sin(k_2\theta)+\ldots+f_n\sin(k_n\theta)$ where $k_0 \ldots k_n$ are constants.

9. The antenna according to claim 1, wherein the radial coefficient r is constant with respect to the axial coefficient z for all of the helical elements.

10. The antenna according to claim 9, wherein the helical elements are provided around the periphery of a cylindrical core.

11. The antenna according to claim 10, wherein said core is hollow and comprises one or more coiled sheets of dielectric material.

12. The antenna according to claim 1, the antenna being a quadrifilar helix antenna, having four helical antenna elements.

13. A mobile communication device comprising:

a multi-filar helix antenna having a plurality of intertwined helical antenna elements, each helical element being defined by an axial coefficient z, a radial coefficient r, and an angular coefficient θ, wherein dθ/dz for all of the helical elements is a non-linear function with respect to the axial coefficient z.

14. A satellite telephone comprising:

a multi-filar helix antenna having a plurality of intertwined helical antenna elements, each helical element being defined by an axial coefficient z, a radial coefficient r, and an angular coefficient θ, wherein dθ/dz for all of the helical elements is a non-linear function with respect to the axial coefficient z.

* * * * *